United States Patent [19]

Dollenmayer

[11] Patent Number: 4,459,054

[45] Date of Patent: Jul. 10, 1984

[54] SHARED CHARACTER SELECTION, ESCAPEMENT AND LINE ADVANCE SYSTEM FOR SERIAL PRINTER

[75] Inventor: William L. Dollenmayer, Versailles, Ky.

[73] Assignee: International Business Machines Corporation, Armonk, N.Y.

[21] Appl. No.: 339,524

[22] Filed: Jan. 15, 1982

[51] Int. Cl.[3] ..... B41J 23/32

[52] U.S. Cl. ..... 400/185; 400/144.2; 400/154.2; 400/154.5; 400/320; 400/322; 400/335; 400/336; 400/568; 400/569; 400/902; 400/903

[58] Field of Search ..... 400/144, 144.1, 144.2, 400/144.3, 144.4, 154.2, 154.5, 155, 155.1, 162.1, 163, 185, 186, 319, 320, 320.1, 322, 332, 335, 336, 336.1, 337, 338.2, 567, 568, 569, 902, 903

[56] References Cited

U.S. PATENT DOCUMENTS

| | | | |
|---|---|---|---|
| Re. 30,942 | 5/1982 | Takenaka | 400/154.2 |
| 1,884,754 | 10/1932 | Krum | 400/186 X |
| 3,710,913 | 1/1973 | Brennan, Jr. et al. | 400/320 |
| 3,804,225 | 4/1974 | Ulin | 400/162.1 X |
| 3,858,704 | 1/1975 | Kawano et al. | 400/567 |
| 3,885,661 | 5/1975 | Okabe | 400/320 |
| 3,951,249 | 4/1976 | Nerbas et al. | 400/335 X |
| 4,030,588 | 6/1977 | Hanagata et al. | 400/185 X |
| 4,239,403 | 12/1980 | Matula et al. | 400/322 |
| 4,244,291 | 1/1981 | Kodaira et al. | 400/155 X |
| 4,264,220 | 4/1981 | Okcuoglu | 400/144.2 |
| 4,338,035 | 7/1982 | Kondo et al. | 400/144.2 |
| 4,359,289 | 11/1982 | Barrus et al. | 400/322 |

FOREIGN PATENT DOCUMENTS

| | | | |
|---|---|---|---|
| 34941 | 3/1980 | Japan | 400/320 |
| 30865 | 3/1981 | Japan | 400/185 |

OTHER PUBLICATIONS

International Publication, WO 80/00817, May 1980, "Drive and Transmission Mechanism of Motions for a Typewriter", Zahner, 9 pp. Spec, 4 sheets drawing.

IBM Technical Disclosure Bulletin, "Spring-Loaded Automatic Belt Tensioner", Blaskovic et al., vol. 24, No. 1A, Jun. 1981, pp. 398-399.

IBM Technical Disclosure Bulletin, vol. 23, No. 2, Jul. 1980, pp. 437-438, "Impact Printer With Carrier And Character-Selection Apparatus Driven Off The Same Motor", T. A. Hoskins et al.

*Primary Examiner*—Ernest T. Wright, Jr.

*Attorney, Agent, or Firm*—John W. Girvin, Jr.

[57] ABSTRACT

A serial impact printer 11 includes a frame 15 mounted drive motor 47 coupled to a print wheel 31 to effect rotation thereof. The print wheel 31 is mounted on a movable print carrier 29 which serially moves from print position to print position along the print line. The motor 47 is coupled to the wheel pulley 51 of the print wheel 31 through a belt 49 which is wrapped about two idler pulleys 57 and 59 located on a sub-carrier 61. The sub-carrier 61 moves one half the distance of the print carrier 29 so that during escapement motion of the print carrier 29, the belt 49 imparts no rotary motion to the wheel pulley 51 and hence to the print wheel 31. The print carrier 29 may be clamped by clamp 77 to the belt 49 to effect the return motion thereof. The motor 47 is also coupled through a clutch 127 to the line feed apparatus of the platen 23.

27 Claims, 9 Drawing Figures

SHARED CHARACTER SELECTION, ESCAPEMENT AND LINE ADVANCE SYSTEM FOR SERIAL PRINTER

BACKGROUND OF THE INVENTION

1. Field of the Invention

This invention relates to serial impact printers and more particularly, to serial impact printers incorporating a shared character selection system, print carrier escapement system and print line advance system.

2. Description of the Prior Art

Prior art serial impact printers and typewriters employing a single element typefont often utilize separate drive systems for driving the typefont along the print line and for driving the typefont to select a particular character for subsequent impact printing. A still further drive system is utilized for the line advance function. This approach is generally costly, not only because of the cost of the independent drive systems employed, but also because such a design approach necessitates heavier duty components. For example, conventional daisy wheel printers use a first motor located on the daisy wheel print carrier to rotate the daisy wheel to effect proper character selection. Since the print carrier is serially moved along the print line from character position to character position, and since the selection motor adds great relative weight to the print carrier, a more powerful motor and print carrier drive system have to be utilized to effect print carrier escapement.

An additional prior art approach utilizes a common drive motor source to drive the character selection system and to drive the print carrier escapement system. Generally, a double clutching arrangement is utilized so that the character selection system is decoupled from the drive source during print carrier escapement and the escapement system is decoupled from the drive source during print character selection. Such double clutching schemes result in slower printing speeds. Since the character selection system must be precise, and since the escapement system generally represents a much greater load on the drive source than that of the character selection system, complex mechanisms are also necessitated to effect the sharing of the common drive source.

An additional prior art approach is described in the IBM Technical Disclosure Bulletin article of July, 1980 at page 437 entitled "Impact Printer With Carrier and Character Selection Apparatus Driven Off The Same Motor". This article describes the use of a single belt to drive both a character selection system and a print carrier escapement system from a single stepper motor. The double clutching arrangement heretofore alluded to is employed to insure engagement of only one of the loads at any given time. The constant coupling and uncoupling of the character selection system from the timing belt can lead to synchronization problems between the timing belt and the print wheel or typefont associated therewith and also slows printing speeds.

SUMMARY OF THE INVENTION

In order to overcome the aforenoted problems of the prior art and to provide a serial impact printer utilizing a common drive source for character selection, print carrier escapement, and for line feed, the present invention provides a unique print carrier and a sub-carrier, each of which are always drivingly connected to the drive source. The character escapement system is coupled and uncoupled from the drive source as is the line feed system through separate clutches. The drive source may be located on the frame of the typewriter/-printer thus removing the weight of the drive source from the print carrier. The combined motion of the print carrier and the sub-carrier insures synchronized motion between the frame mounted drive source and the selectable typefont directly coupled thereto and located on the escaping print carrier. The drive source may be coupled to the character selection system and to the print carrier escapement system by means of a single drive belt. The tautness of the drive belt can be simply adjusted independently of the print carrier escapement system. The escapement system employs a uniform force to effect print carrier motion regardless of the position of the print carrier along the print line.

In a second embodiment, two frame mounted motor sources are utilized to drive the print carrier escapement system and the character selection system. The selection motor drives the selection system through a drive belt connected to the print carrier and a print sub-carrier. The escaping motion of the print carrier has no effect upon character selection due to the drive belt coupling arrangement between the drive source, the sub-carrier and the print carrier. Thus, the selection motor is located on the frame and is always directly coupled to the selection system. Additional embodiments also utilize the print carrier/sub-carrier connection to drive the selection system and the line feed system independent of the motion of the escaping print carrier.

As is set forth hereafter, the various embodiments of the invention can be used in conjunction with existent parts of an IBM "Selectric" Typewriter. Such typewriters are described in the "Selectric" Typewriter Service Manual (Form No. 241-5615-2) dated May, 1975 published by IBM Corporation.

IN THE DRAWING

FIG. 1 is a rear perspective sketch of a portion of a typewriter/printer including the character selection and escapement system of the present invention.

DESCRIPTION

Figure 4:
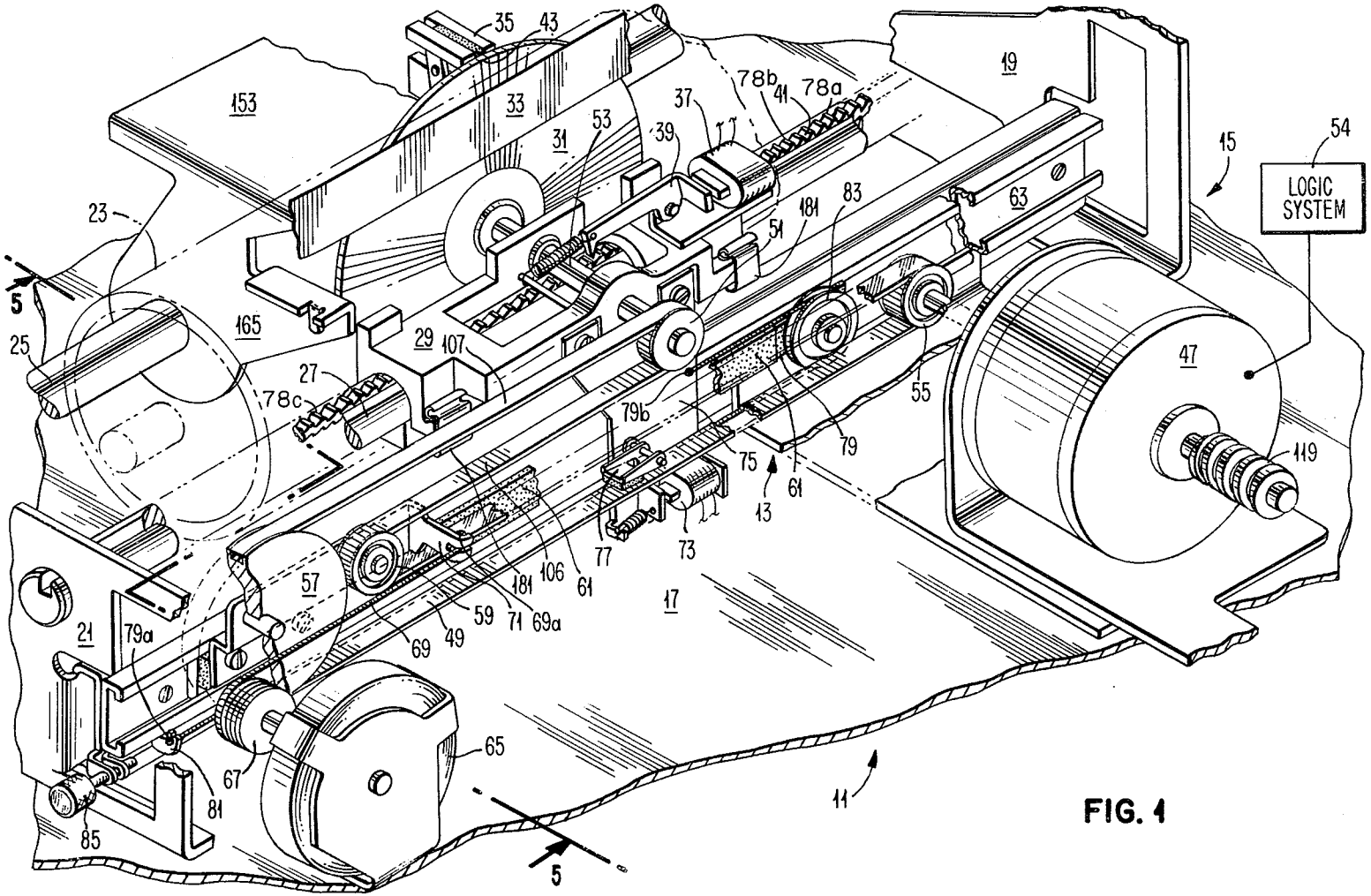
FIG. 4 is a front perspective sketch of a portion of a typewriter/printer.

Referring now to the drawing, and more particularly to FIG. 1 thereof, a rear perspective sketch of a typewriter/printer 11 including the print character selection and escapement system 13 of the present invention is depicted.

The typewriter/printer 11 includes a frame 15 having a bottom plate 17 and side plates 19 and 21. The side plates 19 and 21 support a cylindrical platen 23 about which a print receiving document 24 of FIG. 4 may be wrapped to receive printing thereon. The side plates 19 and 21 also support rails 25 and 27, the axes of which are aligned parallel to the axis of the platen 23. The rails 25 and 27 support a print carrier 29 which moves along the length of the platen 23 as will be described. The print carrier 29 rotatably supports a daisy type print wheel 31, supports print ribbon 33, and supports print hammer unit 35. Additionally, the print carrier 29 supports escapement magnet 37 and pawl 39, the latter coacting with rack 41 located within rail 27 to fixedly position the print carrier 29 when the pawl 39 engages the rack 41.

In order to select the proper character for printing, print wheel 31 is rotated until the daisy petal 43 bearing the selected character is aligned adjacent the print hammer unit 35. Printing is then effected upon energization of the print hammer unit 35 which drives the daisy petal 43 into the print ribbon 33 and thence onto the print receiving document 24 of FIG. 4 located on the platen 23.

Thereafter, the escapement magnet 37 is energized effecting the removal of the pawl 39 from the rack 41 thereby allowing the print carrier 29 to move or escape toward the next print position as will be described hereafter. The pawl 39 is then allowed to re-engage the rack 41 thus precisely locating the print carrier 29 at the next print position.

In order to effect the rotational motion of the print wheel 31, the stepper motor 47 is rotated. The stepper motor 47 is connected by the continuous belt 49 to the wheel pulley 51. The wheel pulley 51 is fixedly secured to the stub shaft 53 which is journaled for rotation on the print carrier 29. Additionally, the print wheel 31 is fixedly secured to the stub shaft 53 so that rotation of the stub shaft 53 effects rotation of the print wheel 31. Accordingly, when the logic system 54 causes the stepper motor 47 to rotate, the print wheel 31 rotates a corresponding amount.

The belt 49 is also wrapped about the motor pulley 55, idler pulley 57, and idler pulley 59. The idler pulleys 57 and 59 are located on a sub-carrier 61 which, as will be described hereafter, moves in a direction parallel to the movement of the print carrier 29 by one-half of the distance that the print carrier 29 moves. It is this belt 49 and pulleys 51, 55, 57, 59 arrangement which allows the conjoint movement of the print carrier 29 and the sub-carrier 61 during escapement without affecting the rotational position of the motor pulley 55, the wheel pulley 51 and hence the print wheel 31. The sub-carrier 61 moves in a slotted guide-way 63 connected to the side plates 19 and 21.

A spring motor 65 is utilized to provide an escapement biasing force for the print carrier 29 and the sub-carrier 61. The spring motor 65 is mounted on the bottom plate 17 and exerts a winding torque on the cord drum 67 about which cord 69 is wrapped. The free end 69*a* of the cord 69 is attached to the bracket 71 located on the sub-carrier 61. The spring motor 65 thus exerts a force on the sub-carrier 61 biasing it toward the left as viewed. This force is transmitted through the belt 49 to the pulley 51 and hence to the print carrier 29. Thus, upon energization of the escapement magnet 37 thereby releasing the pawl 39 from the rack 41, the force exerted by the spring motor 65 effects escapement motion of the sub-carrier 61 and the print carrier 29 in a leftward direction as viewed.

Once a line of printing has been completed and it is desired to move the print carrier 29 back to its rightmost position as viewed, return magnet 73 is energized. The return magnet 73 is located on an extension 75 of the print carrier 29. Energization of the return magnet 73 causes the clamp 77 located on the extension 75 to forceably engage the belt 49 thus locking the print carrier 29 thereto. Also, the escapement magnet 37 is energized to remove pawl 39 from the rack 41 to reduce noise during print carrier 29 return. The stepper motor 47 is then rotated causing the motor pulley 55 to rotate in a counterclockwise direction thus effecting movement of the print carrier 29 toward the right as viewed. The print carrier 29 is over driven slightly beyond the left margin stop position 78*a* allowing the spring motor 65 to drive the print carrier 29 to the left margin stop position 78*a* once the escapement magnet 37 and the return magnet 73 are de-energized.

Since the belt 49 is placed into motion by the stepper motor 47, the wheel pulley 51 is also rotated effecting corresponding rotation of the print wheel 31. Since this rotation of the print wheel 31 occurs during a print carrier 29 return operation, during which time printing does not take place, the logic system 54 must keep track of the amount of rotation effected by the print wheel 31. It is noted that during the return motion of the print carrier 29 and sub-carrier 61, the spring motor 65 is rewound.

In a similar manner, when a single backspace operation is desired, the return magnet 73 is energized and the stepper motor 47 is thereafter rotated to effect the desired backward increment of the print carrier 29. As with all rack and pawl systems, the backward increment is greater than the increment defined by the rack 41 so that the print carrier 29 is overdriven in the backspace direction. The spring motor 65 returns the print carrier 29 to its precise position once positioning drive to the stepper motor 47 ceases and the return magnet 73 is de-energized. It is noted that the escapement magnet 37 remains de-energized during the backspace operation.

Tabulation (reverse and forward) of the print carrier 29 is effected in a manner similar to that of a print carrier 29 return operation. In a reverse tabulation operation the stepper motor 47 is caused to stop just beyond a tab position 78*b* and prior to the left margin stop position 78*a*. Otherwise, the operation is the same as heretofore described. In a forward tabulation operation, the stepper motor 47 stops the print carrier 29 immediately prior to the tab position 78*c*. The escapement magnet 37 is then released, the return magnet 73 is de-energized and the spring motor 65 then moves the print carrier 29 to the tab position 78*c* where the pawl 39 seats in the rack 41.

Greater tautness in belt 49 is required than that provided by spring motor 65 to insure proper selection performance. This is accomplished by biasing the sub-carrier 61 in an opposite direction from the print carrier 29. This bias manifests itself as a uniform force in belt 49 and is applied by cord 79 which is secured at one end 79*a* to the adjustable bracket 81 and at its other end 79*b* to the extension 75 of the print carrier 29. The cord 79 also wraps about the idler pulley 83 located on the sub-carrier 61. The adjusting screw 85 causes the adjustable bracket 81 to move relative to the side plate 21. Adjustment of the adjusting screw 85 thus controls the biasing force which keeps the print carrier 29 biased away from the sub-carrier 61 and hence controls the tautness of the belt 49.

Figure 2:
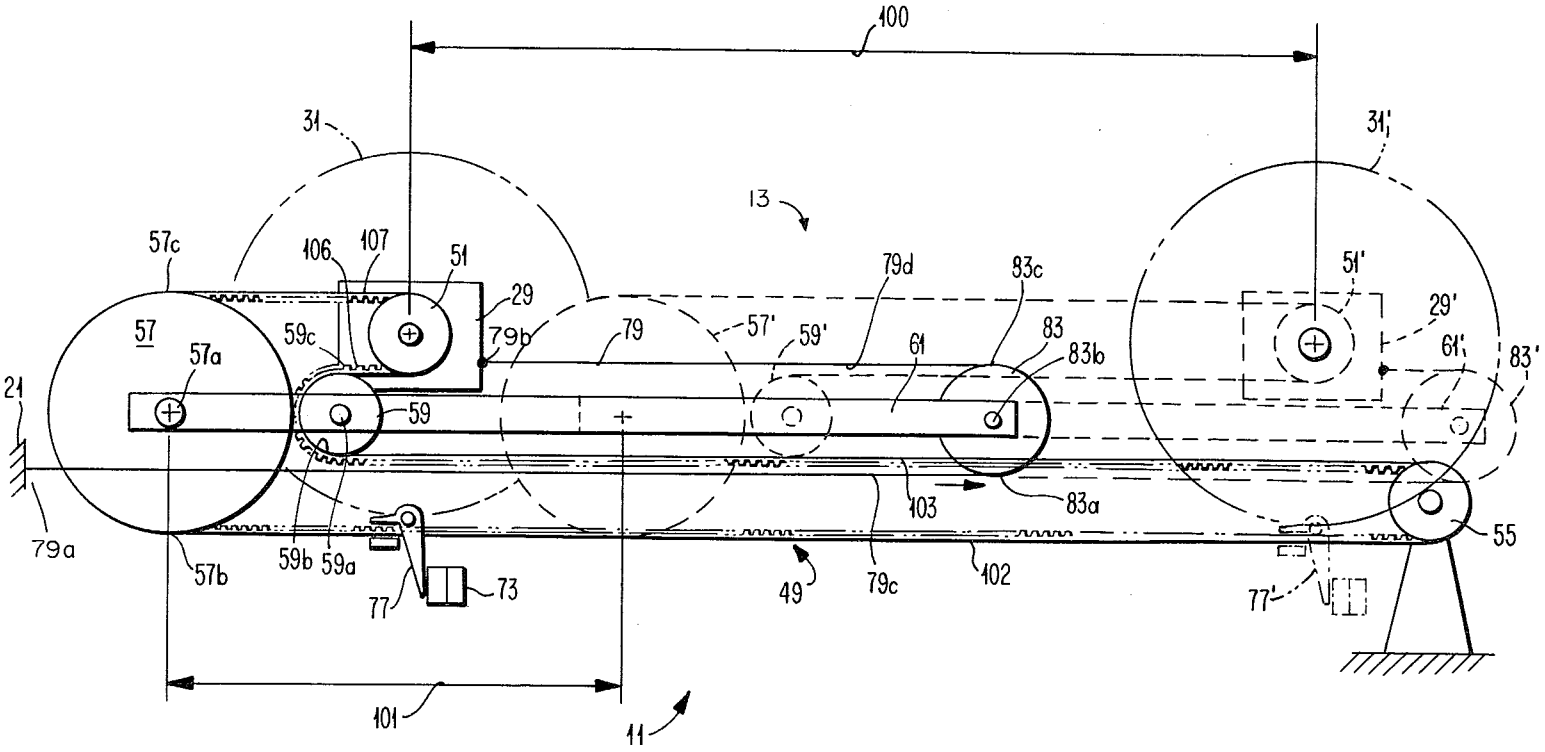
FIG. 2 is a rear schematic sketch of the character selection and escapement system of the present invention.

Referring now to FIG. 2 of the drawing, a rear schematic sketch of the character selection and escapement system 13 of the present invention is depicted. This sketch is utilized to show the relationship of the belt 49 to the various pulleys 51, 55, 57, 59, 83 as the print carrier 29 and the sub-carrier 61 move from a first (phantom line, primed number) position to a second (solid line) position. Additionally, this sketch is utilized to describe the various forces acting upon the belt 49 system.

In order to effect conventional left to right printing, the print carrier 29 carrying the print wheel 31 is moved along the print line a distance 100 during which time the sub-carrier 61 is moved in the same direction by a distance 101 equal to one half of the distance 100. Since the sketch depicts a rear view similar to that viewed in FIG. 1, print escapement motion is to the left from the phantom line primed number positions toward the solid line positions of the various components depicted. The escapement motion of the print carrier 29 and sub-carrier 61 which is effected independently of the rotation of the motor pulley 55 and hence the print wheel 31 is described next.

Since the motor pulley 55 is rotated only during character selection, tabbing, and during the return motion of the print carrier 29, it is not turning as the print carrier 29 escapes from the right (phantom line) position toward the left position as viewed. Thus, flat sections 102 and 103 of the continuous belt 49 do not move and appear as a ground plane to the print carrier 29 and the sub-carrier 61 which do move relative thereto. As a result, the idler pulleys 57 and 59 located on the sub-carrier 61 effectively roll on sections 102 and 103 of the belt 49 when motion of the sub-carrier 61 and print carrier 29 occurs. The centers 57*a* and 59*a* of the idler pulleys 57 and 59 respectively are constrained by the sub-carrier 61 so that they both move as a unit in a direction parallel to the straight sections 102 and 103 of the belt 49. Consequently, points 57*b* and 59*b* which are kinematically instantaneous centers, and points 57*c* and 59*c* which are diametrically opposite to points 57*b* and 59*b* will always move parallel to and with a motion that is twice that of the centers 57*a* and 59*a*. (This is the property of any rolling circle). Thus, straight sections 106 and 107 of the belt 49 are imparted with identical linear motions twice that of the sub-carrier 61 because the centers 57*a* and 59*a* of the idler pulleys 57 and 59 have the same motion as the sub-carrier 61.

In a similar manner, idler pulley 83 rolls on the ground plane portion 79*c* of cord 79 with point 83*a* being an instantaneous center. Since the center 83*b* of idler pulley 83 undergoes the same motion as the sub-carrier 61, point 83*c* is also imparted motion twice that of the sub-carrier 61, which is the same motion as sections 106 and 107 of belt 49. Since the belt 49 is wrapped around idler pulleys 57 and 59 opposite to the wrap of cord 79 about idler pulley 83, sections 106 and 107 of belt 49 increase in length equally and oppositely to section 79*d* of cord 79 insuring free motion of the print carrier 29 during escapement.

Since the sections 106 and 107 of the belt 49 are both moving in the same direction with the same velocity, the wheel pulley 51 does not rotate, but instead, is translated in the same direction as the sub-carrier 61 at twice the sub-carrier 61 velocity of motion. This motive force, applied by the belt sections 106 and 107 to the wheel pulley 51 effects the linear motion of the print carrier 29 to which the wheel pulley 51 is secured.

Referring once again to FIG. 1 of the drawing, it has been described that the spring motor 65 exerts an external force through the cord 69 to the sub-carrier 61. This external force is transmitted through the sections 106 and 107 of the belt 49 to the pulley 51 and hence to the print carrier 29 as just described. This force is superimposed on the bias force in belt 49 that is produced by cord 79. When the pawl 39 is removed from engagement with the rack 41, the spring motor 65 force effects motion of the print carrier 29 until the pawl 39 again re-engages the rack 41. One half of the distance traversed by the print carrier 29 is traversed by the sub-carrier 61 as described. In order to insure this relationship, it is necessary that the belt 49 be taut dynamically as well as statically. The cord 79 maintains the belt 49 taut with a uniform bias force that can be adjusted by the adjusting screw 85.

With reference again to FIG. 2 of the drawing, it can be seen that the cord 79 is grounded at the end plate 21 at its end 79*a* and is wrapped about the idler pulley 83 attached to the sub-carrier 61 and thence attached to the print carrier 29 at its end 79*b*. As the cord 79 is shortened at the side plate 21 (e.g., by means of the adjusting screw 85 of FIG. 1), it forces the print carrier 29 to tend to move to the right and at the same time forces the sub-carrier 61 to move to the left. The resulting force in cord 79 tending to separate the print carrier 29 and sub-carrier 61 is opposed by equal tensioning forces in sections 106 and 107 of the belt 49. Further, the equal tension force in each section 106, 107 of the belt 49 is one half of that of the cord 79. The same equal tension force that exists in section 106 and 107 of the belt 49 also exists in sections 102 and 103 of the belt 49. Further, the external pull of cord 79 on the print carrier 29 and sub-carrier 61 is balanced by the external pull of the grounded motor pulley 55 on the belt 49. This tensioning or biasing scheme therefore results in a balance of horizontal forces in the direction of escapement so that the print carrier 29 and sub-carrier 61 are maintained in static equilibrium. No motion of the print carrier 29 and sub-carrier 61 will result until the additional external force produced by spring motor 65 is superimposed onto the biasing forces produced by the action of cord 79. It is important to note that the ability to bias or tension the selection belt 49 and have the print carrier 29 and sub-carrier 61 in static equilibrium allows means other than spring motor 65, such as a D.C. motor, to produce escapement motion.

Ideally, it is desirable for the belt 49 and the cord 79 to be acting in a common plane to thereby eliminate any torsional moments on the print carrier 29 and sub-carrier 61. Such moments would create reaction forces between the print carrier 29 and its support rails 27 and similarly for the sub-carrier 61. This condition leads to frictional drag on the print carrier 29 and sub-carrier 61 that could result in degraded performance. Thus, the cord 79 has been positioned adjacent to the belt 49 as close as practically possible to minimize this condition.

With reference again to FIG. 2 of the drawing, the phantom view shows the print carrier 29' and sub-carrier 61' at their extreme left position in the typewriter/-printer 11.

It should be noted that idle pulley 83 must always be positioned to the left of its point of attachment to the print carrier 29. This results in the sub-carrier 61 being a long slender member. This in turn allows the use of very loose slider bearings 179 (see FIG. 5) at each end of the sub-carrier 61 and still maintains the necessary parallelism of the belt 49 and cord 79 to insure accurate positioning of the printwheel 31 as it traverses across the typewriter/printer 11.

As previously described, in order to effect rotary motion of the wheel pulley 51 and hence the print wheel 31, the motor pulley 55 is rotated. This causes the belt 49 to move a corresponding distance in the direction of rotation thus effecting rotational movement of the pulleys 51, 57, 59 connected to the belt 49.

Also, as previously described, when it is desirable to move the print carrier 29 from the leftmost position toward the rightmost (phantom line) position as viewed, return magnet 73 is energized causing clamp 77 to engage the belt 49. The clamp 77 is secured to an extension 75 (FIG. 1) of the print carrier 29. As section 102 of the belt 49 is moved rightward as viewed, the clamp 77 and print carrier 29 translate to the right. The sections 106, 107, 102 and 103 of the belt 49 effect a force on the sub-carrier 61 causing the sub-carrier 61 to move one half the distance 101 as the distance 100 traversed by the print carrier 29. During motion of the print carrier 29 to the right as viewed, the print wheel 31 rotates in accordance with the motion transmitted to the belt 49 by motor pulley 55. The rotation of the print wheel 31 is identical to that which would occur if clamp 77 were not engaged. Thus, as will be described, the print position of the print wheel 31 must be kept track of during such return motion. This is done in the same manner as when the print carrier 29 is held stationary and the belt 49 is moved to effect character selection.

Referring once again to FIG. 1 of the drawing, it has been described how the stepper motor 47 imparts rotational movement to the print wheel 31 through the belt 49 and further, how the stepper motor 47 cooperating with clamp 77 returns the print carrier 29 and the sub-carrier 61 to their rightmost positions by driving the belt 49. Additionally, it has been described how the spring motor 65 coacts with the pawl 39 and rack 41 to effect motion of the sub-carrier 61 toward the left and how that motion is transmitted through the belt 49 to effect twice as much motion of the print carrier 29 toward the left. Additionally, the stepper motor 47 may be utilized to effect indexing movement of the platen 23 in order to advance the writing line.

Figure 3:
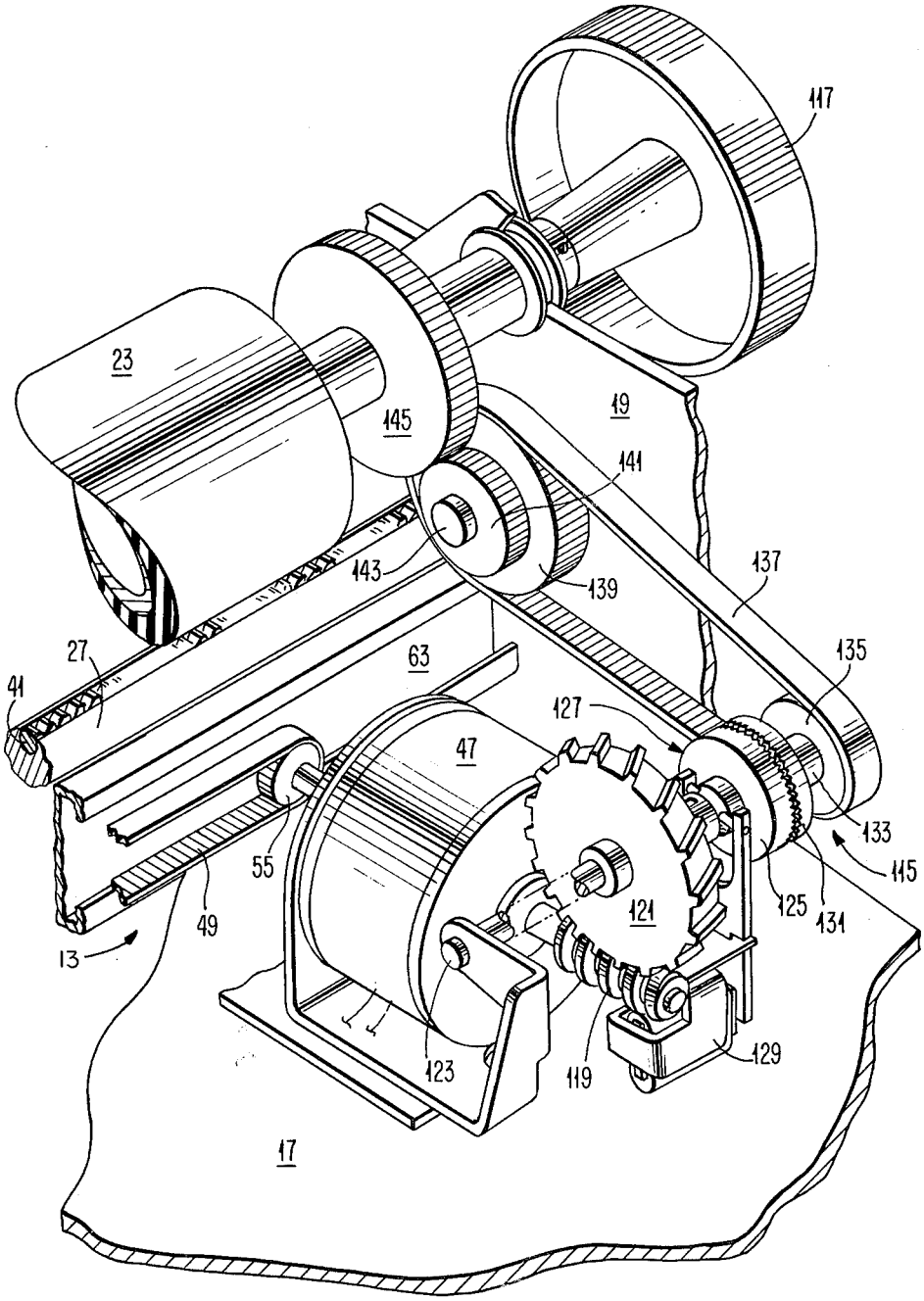
FIG. 3 is a rear perspective sketch of a portion of the character selection and escapement system depicting the line feed apparatus.
Figure 4:
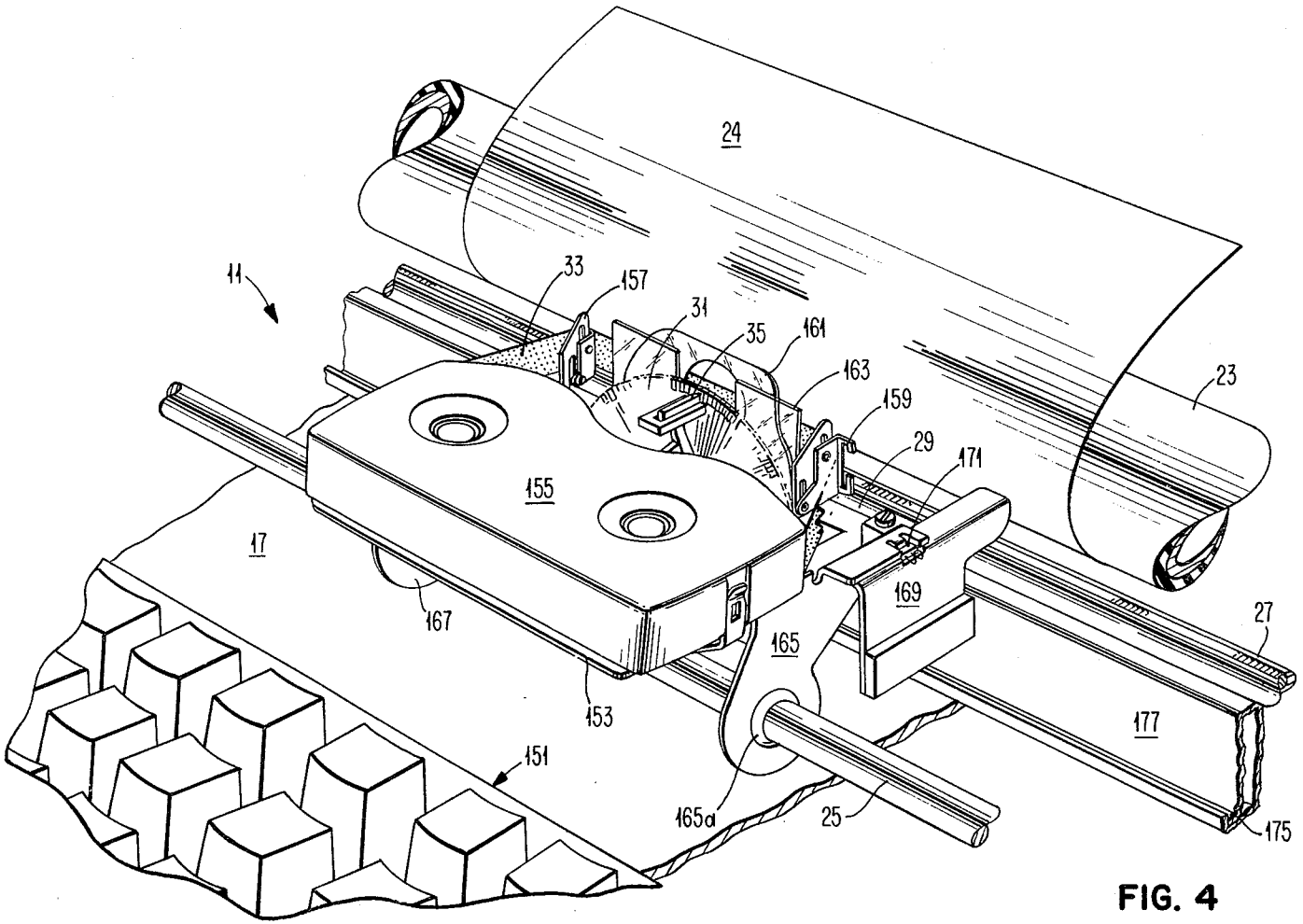

Referring now to FIG. 3 of the drawing, a rear perspective sketch of a portion of the character selection and escapement system 13 depicting the line feed apparatus 115 is shown. Line feed is effected upon rotation of the platen 23. The platen 23 is journaled for rotation on the side plate 19 and on the opposite side plate 21 of FIG. 1. Rotary motion may be imparted by the operator turning the platen knob 117 in a conventional fashion or by operation of the stepper motor 47 in a manner to be described. The platen 23 is mechanically detented using a conventional ratchet wheel and pawl arrangement (not shown) such as that employed in the IBM "Selectric" typewriter.

Rotation of the stepper motor 47 drives the worm gear 119 which in turn imparts rotary motion to the worm pinion 121. The worm pinion 121 is coupled to the shaft 123 which is also attached to the drive arbor 125 of the clutch 127. The line feed magnet 129 is energized causing the drive arbor 125 of the clutch 127 to be coupled to the driven arbor 131. The rotary motion of the shaft 123 is thus coupled to the shaft 133 effecting rotation of the pulley 135. Rotation of the pulley 135 is transmitted through the belt 137 to the pulley 139 and thence to the gear 141 mounted on a common stub shaft 143. The gear 141 drives the gear 145 which effects rotation of the platen 23.

Thus, when it is desirable to automatically index the platen 23 to effect a line feed operation, the line feed magnet 129 is energized coupling the gear 145 through the clutch 127 to the worm gear 119. The stepper motor 47 is then driven to effect the proper incremental motion of the platen 23. It is noted that during this operation, the motor pulley 55 rotates effecting motion of the belt 49. Since movement of the belt 49 effects corresponding motion of the print wheel 31 of FIG. 1, it is necessary for the logic system 54 of FIG. 1 to keep track of the print wheel 31 location during a platen 23 indexing operation.

While the platen 23 has been represented without its carriage and attendant paper feed rolls, it is noted that the platen carrier and feed system may be identical to that employed in the IBM "Selectric" typewriter.

Referring now to FIG. 4 of the drawing, a front perspective sketch of a portion of the typewriter/-printer 11 is depicted. This sketch depicts the relationship of the keyboard 151 to the print wheel 31, and platen 23. As previously described, the print carrier 29 carries the print ribbon 33, the print wheel 31 and the print hammer unit 35 therewith as it moves over the rails 25 and 27. A ribbon plate 153 supports a ribbon cartridge 155 which contains a supply of ribbon 33. The ribbon 33 passes through the ribbon guides 157 and 159 also carried by the ribbon plate 153. The ribbon 33 passes between a card holder 161 and the ribbon shield 163. The ribbon plate 153 mechanisms for effecting the feeding of the ribbon 33 and the lifting of the ribbon guides 157 and 159 during printing operations may be identical to those employed in the IBM "Selectric" typewriter. The ribbon plate 153 is principally supported by descending arms 165 and 167 which ride over the rail 25 as the print carrier 29 is moved in a direction parallel to that of the axis of the platen 23. The descending arm 165 clamps onto the member 169 which forms a part of the print carrier 29. In order to remove the entire ribbon plate 153 from the print carrier 29, the clamp 171 is released allowing the ribbon plate 153 and its descending arms 165 and 167 to rotate in a counterclockwise direction as viewed about the rail 25. This allows the various mechanisms on the ribbon plate 153 to be readily serviced.

Additionally, the load of the ribbon plate 153 is transmitted to a single pivot point at the clamp 171. By having the ribbon plate 153 assembly move on its own bearings **165*a* and support rail 25, any of its own torsional oscillations during print carrier 29 motion are absorbed by its own bearings 165*a* and support rail 25 and not transmitted to the print carrier 29. This bearing arrangement effectively makes the mass of the ribbon plate 153 assembly appear as a point mass at clamp 171. This minimizes any effects of the mass of the ribbon plate 153 assembly on the print carrier 29** during escapement operations.

Figure 5:
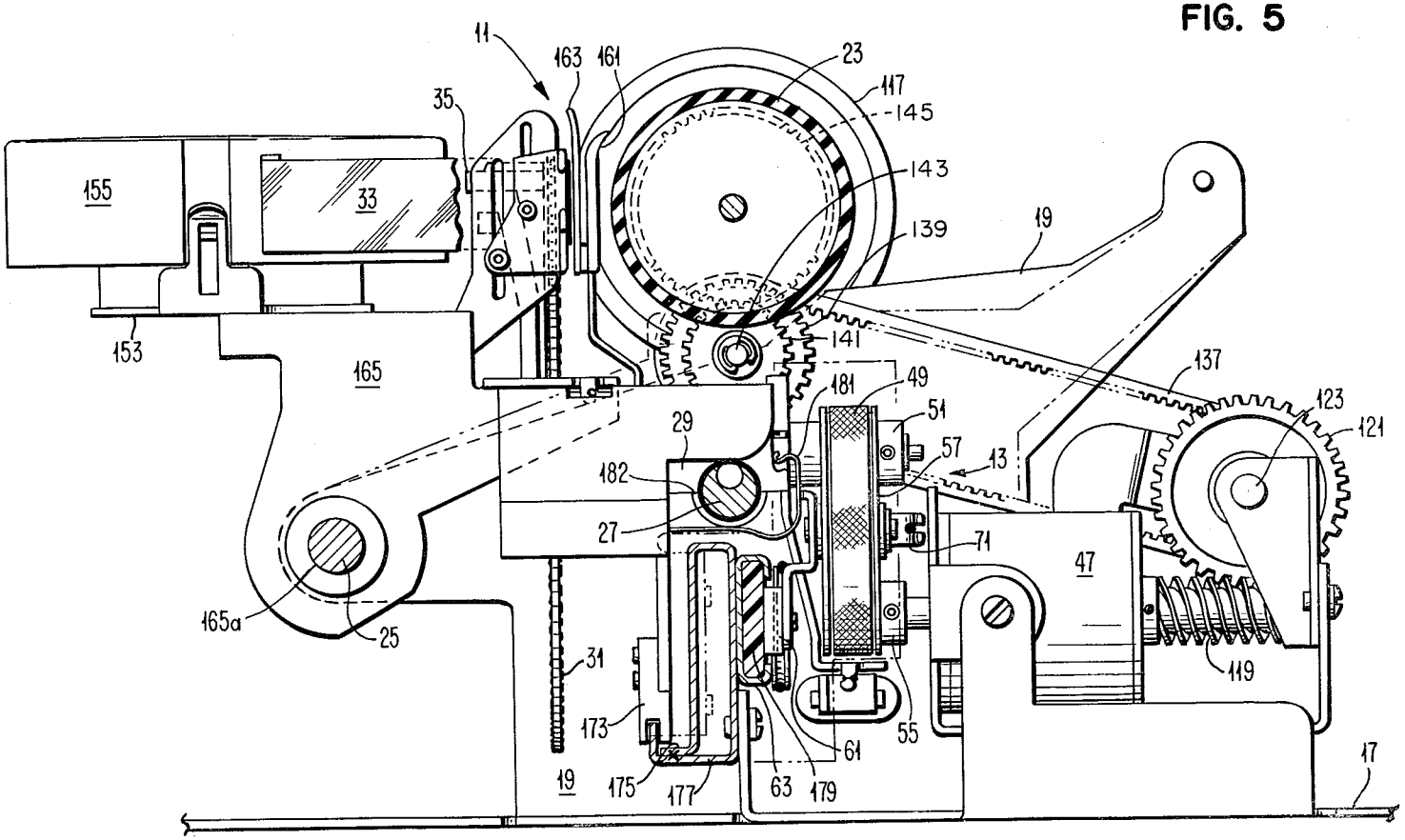
FIG. 5 is an end sectional view along section line 5—5 of FIG. 1 of a typewriter/printer incorporating the character selection and escapement system of the present invention.

In order to prevent the print carrier 29 from rotating about the shaft 27, a downwardly descending shoe 173, shown in FIG. 5, attached to the print carrier 29 extends into the channel 175 formed in the frame guide 177. It is noted that the slotted guideway 63 of FIG. 1 is supported on the reverse side of the frame guide 177.

Referring now to FIG. 5 of the drawing, an end sectional view taken along section lines 5—5 of FIG. 1 of the typewriter/printer 11 incorporating the character selection and escapement system 13 of the present invention is depicted. This view depicts the relationship of the frame guide 177, the channel 175 and the slotted guideway 63. The slotted guideway 63 supports the slider bearing 179 for sliding motion there-along. The slider bearing 179 forms a part of the sub-carrier 61. Additionally, the clips 181 hold the two bearings 182 of the print carrier 29 together about the rail 27. Removal of the clips 181 allows separation of the bearings 182 for service and easy removal of print carrier 29.

Figure 6:
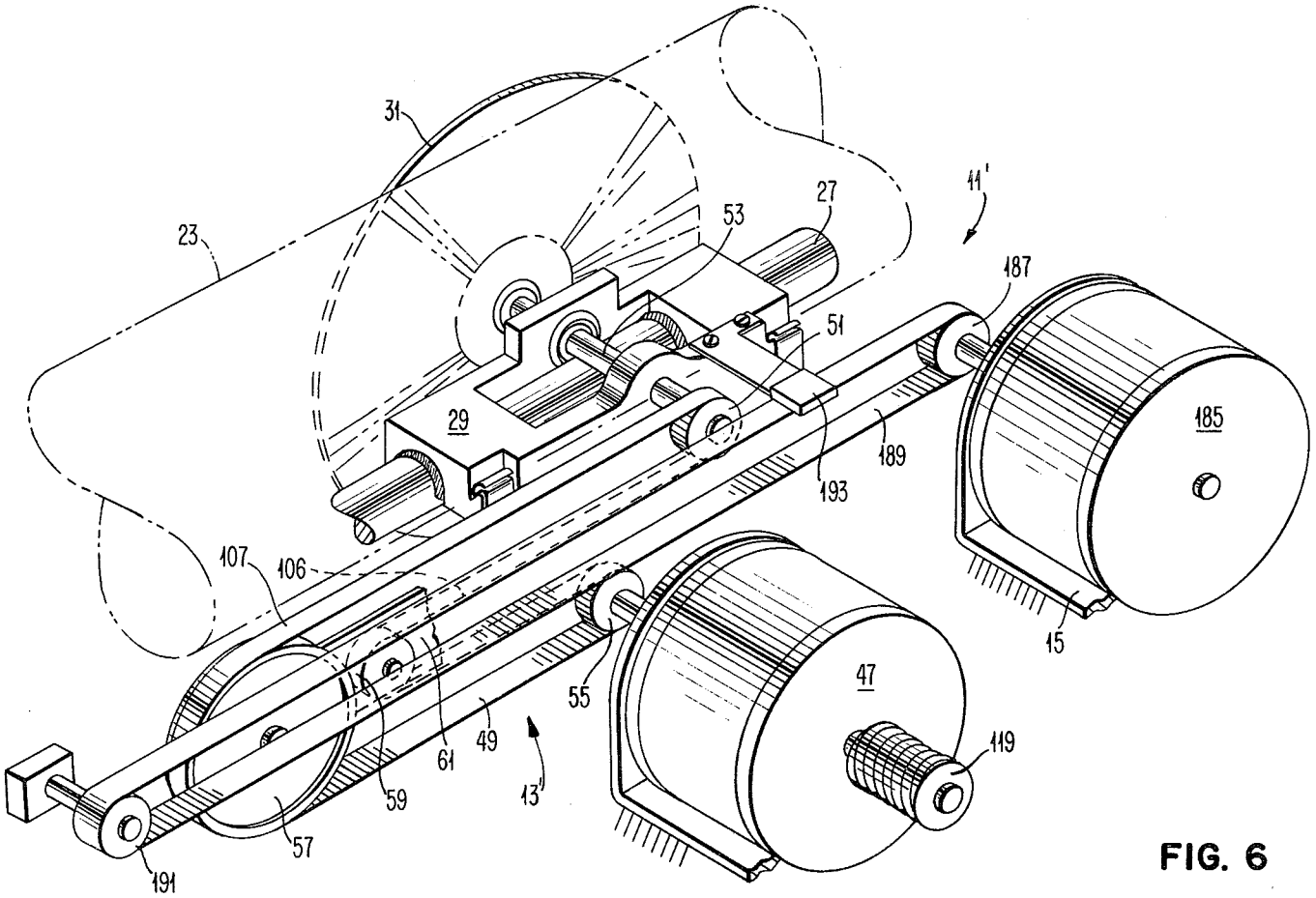
FIGS. 6, 7 and 8 are each perspective sketches of different alternate embodiments of a typewriter/printer including the character selection and escapement system of the present invention.

Referring now to FIG. 6 of the drawing, a perspective sketch of an alternate embodiment of the typewriter/printer 11' including the character selection and escapement system 13' of the present invention is depicted.

In this embodiment, a second frame 15 mounted stepper motor 185 is utilized to power and drive the print carrier 29 escapement and return functions. The stepper motor 185 effects rotation of the pulley 187 and hence the drive belt 189 connected thereto. The drive belt 189 is wrapped about the grounded pulley 191 and further is attached to the belt clamp 193 which is in turn attached to the print carrier 29. Rotation of the pulley 187 thus effects linear motion of the belt 189 and corresponding linear motion of the print carrier 29 parallel to the platen 23 axis. This system accurately positions the print carrier 29 to any designated position along the print line so that the rack 41, pawl 39, clamp 77 and return magnet 73 of FIG. 1 are not necessitated. Further, the stepper motor 185 can be utilized to provide proportional spacing or spacing at any desired print increment as opposed to the fixed increment defined by the pitch of the rack 41.

Rotation of the stepper motor 47 effects line feed through the worm gear 119 in the same manner as hitherto described with respect to the embodiment of FIGS. 1 and 3. Rotation of the stepper motor 47 also effects character selection by causing print wheel 31 to rotate as in the embodiment of FIG. 1.

The character selection system is identical to that described with respect to FIG. 1. That is, idler pulleys 57 and 59 are located on a sub-carrier 61 which moves one half the distance that the print carrier 29 traverses during escapement and return operations. The continuous belt 49 extends from the motor pulley 55 about the idler pulley 57, thence about the wheel pulley 51 and thence about the idler pulley 59 back to the motor pulley 55. The belt 49 is biased with a pretension by a cord 79 and pulley 83 arrangement as shown in FIG. 1 but deleted in FIG. 6 for clarity. Rotation of the motor pulley 55 as effected by the stepper motor 47 causes corresponding rotation of the wheel pulley 51 and hence the print wheel 31. Movement of the print carrier 29 is effected by the drive belt 189 and places a force on the belt sections 106 and 107 which causes the sub-carrier 61 to move one-half the distance moved by the print carrier 29. The combined motion of the print carrier 29 and the print sub-carrier 61 during escapement and return operations of the print carrier 29, which can occur without the rotation of motor 47, prevents the rotational movement of the wheel pulley 51 relative to the motor pulley 55 as has been previously described.

Figure 7:
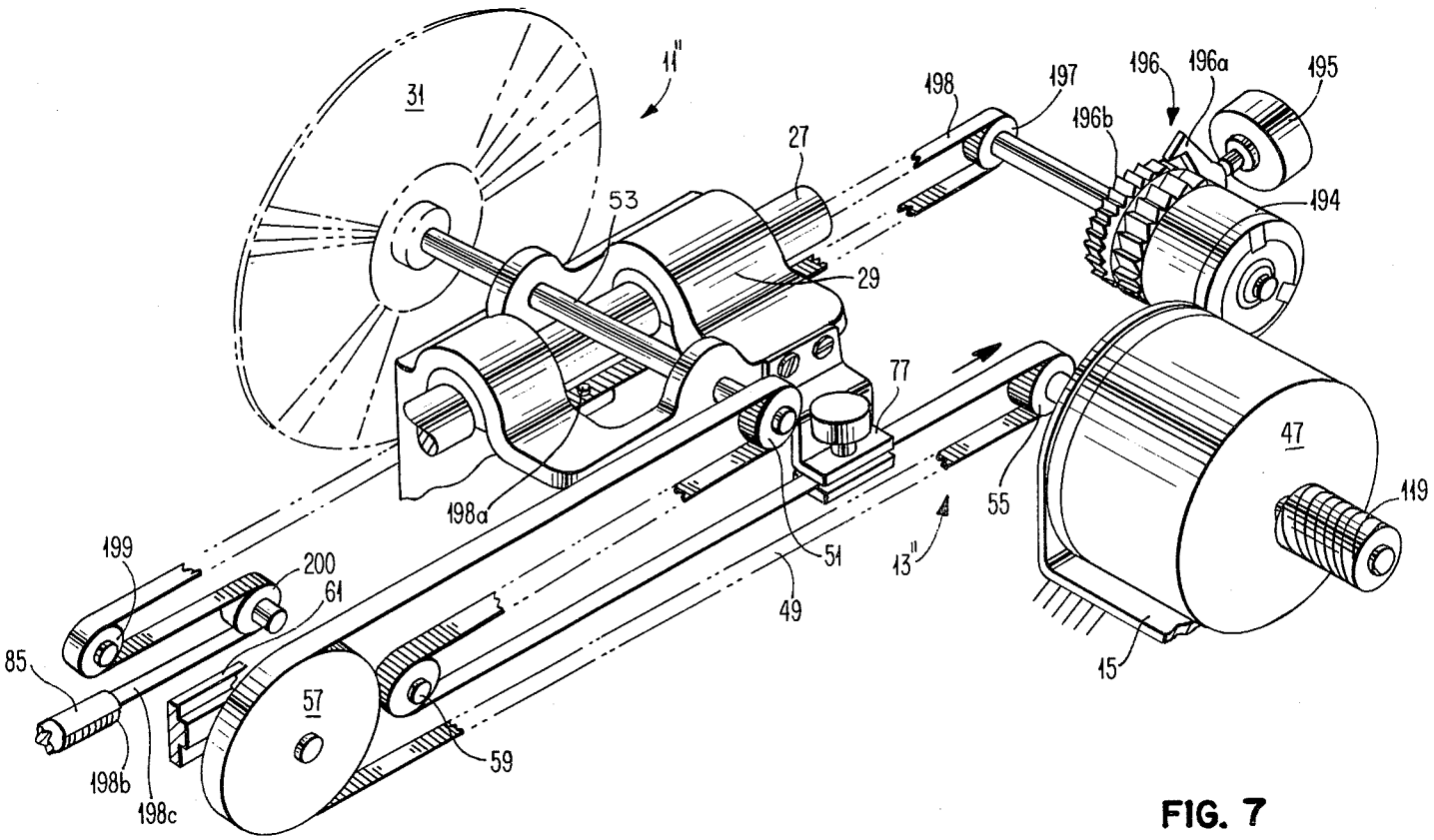

Referring now to FIG. 7 of the drawing, a perspective sketch of a still further alternate embodiment of the typewriter/printer 11'' including the character selection and escapement system 13'' of the present invention is depicted. In this embodiment, a second frame mounted DC motor 194 or a spring motor 65 as in FIG. 1 is utilized in conjunction with a solenoid 195 actuated dual pitch rotary escapement system 196 to power and drive the escapement system instead of the linear dual pitch rack 41 shown in FIG. 1. Actuation of the solenoid 195 releases the pawl **196*a* from the rotary rack 196*b* allowing the DC motor 194 (or spring motor 65) to rotate the motor pulley 197 in a clockwise direction as viewed. Motion of the motor pulley 197 effects corresponding motion of the belt 198 which is fixedly secured at its end 198*a* to the print carrier 29 and at its opposite end 198*b* to the adjusting screw 85 attached to side plate 21 of FIG. 1. The belt 198 also passes around the fixed pulley 199 which is grounded to the frame guide 177 of FIG. 5 and around the pulley 200 located on the sub-carrier 61**.

Rotation of the motor pulley 197 in a clockwise direction effects translation of the pulley 200 mounted on the sub-carrier 61 in a leftward direction as viewed. Translation of the sub-carrier 61 causes the idler pulleys 57 and 59 attached thereto to also be translated. These pulleys 57, 59, acting through belt 49 cause the print carrier 29 to move leftward twice the distance moved by the sub-carrier 61.

Since section **198*c* of belt 198 is a ground plate to pulley 200 which is attached to the sub-carrier 61, belt 198 and pulley 200 are analogous to cord 79 and pulley 83 in FIG. 1** and perform a similar function as previously described.

When a backspace operation or print carrier 29 return operation is required, clamp 77 is actuated and the stepper motor 47 is energized to effect the return motion as heretofore described with respect to FIG. 1. Since power to the DC motor 194 can be shut off or even reversed at this time, the load seen by the stepper motor 47 is less than that with the embodiment described with respect to FIG. 1. An additional advantage to the embodiment depicted in FIG. 7 is that by adjusting the adjusting screw 85, both the escapement belt 198 system and the selection belt 49 system are drawn taut. Further, the rotary rack **196*b* which is more compact than the rack 41 of FIG. 1 can be utilized. It is noted that the selection system which is driven by stepper motor 47 to effect rotation of printwheel 31 is identical to that described with respect to FIG. 1**.

Figure 8:
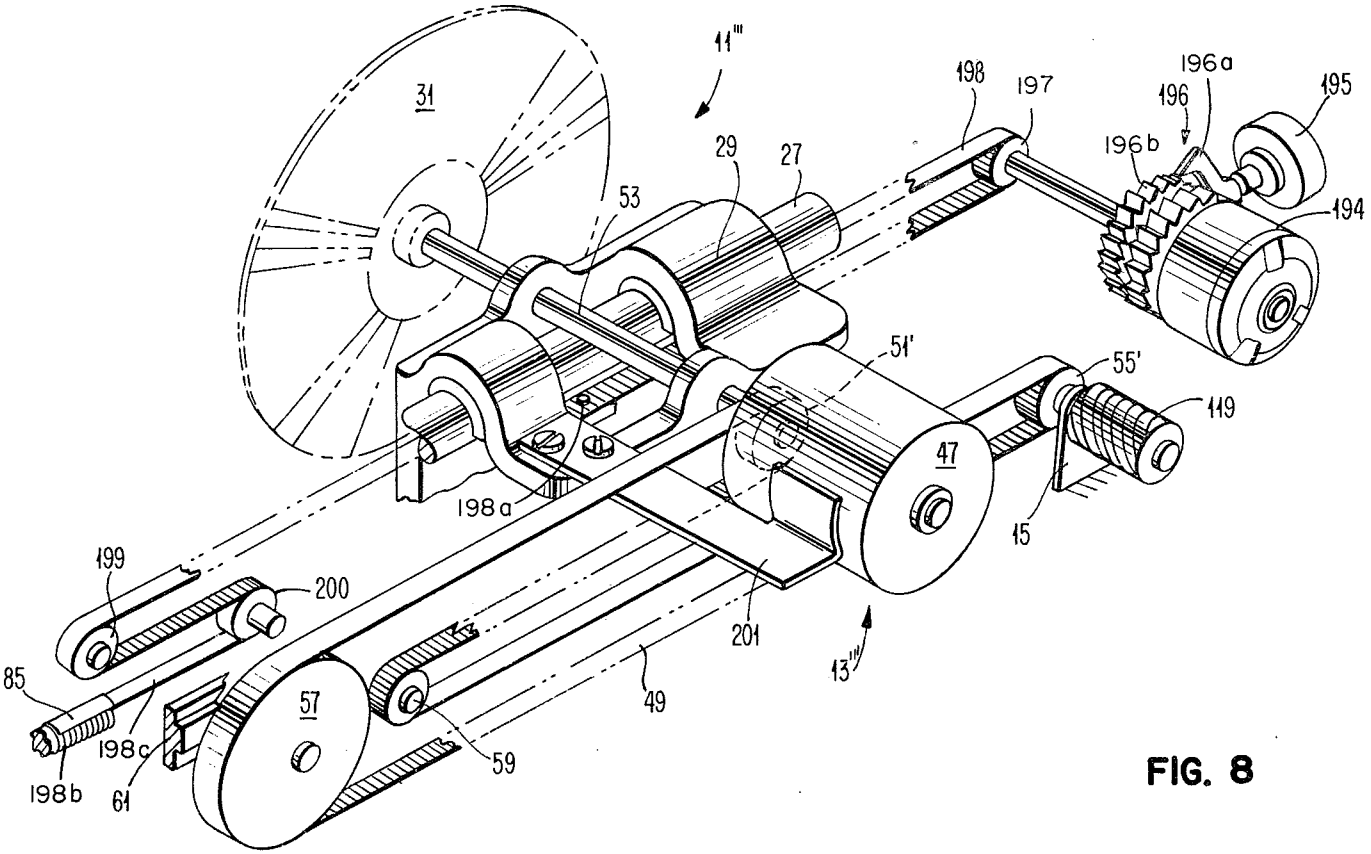

Referring now to FIG. 8 of the drawing, a perspective sketch of a still further alternate embodiment of the typewriter/printer 11''' including the character selection and escapement system 13''' of the present invention is depicted.

This system 13''' utilizes the same escapement system 13''' described with respect to FIG. 7 of the drawing. However, the stepper motor 47 is directly mounted by bracket 201 to the print carrier 29. Rotation of the stepper motor 47 effects rotation of the stub shaft 53 directly coupled thereto and hence the printwheel 31 coupled to the stub shaft 53. Rotation of the stepper motor 47 also effects rotation of the wheel pulley 51' and corresponding rotation of the idler pulleys 57, 59 and pulley 55'. The pulley 55' is grounded to the machine frame 15 and is connected to the worm gear 119. The worm gear 119 is identical to that depicted in FIG. 3 of the drawing and may be connected in a similar fashion to the platen 23 of FIG. 3 of the drawing. In this embodiment, the stepper motor 47 output may be used to precisely locate the printwheel 31 rotary positions without regard to any inaccuracies that could result from belt 49 and sub-carrier 61. Additionally, rotation of the stepper motor 47 effects the line indexing function while the print escapement motion of the print carrier 29 has no effect on either the line indexing or the selection functions due to the conjoint positioning of the print sub-carrier 61 and its pulleys 57, 59 and 200.

Figure 9:
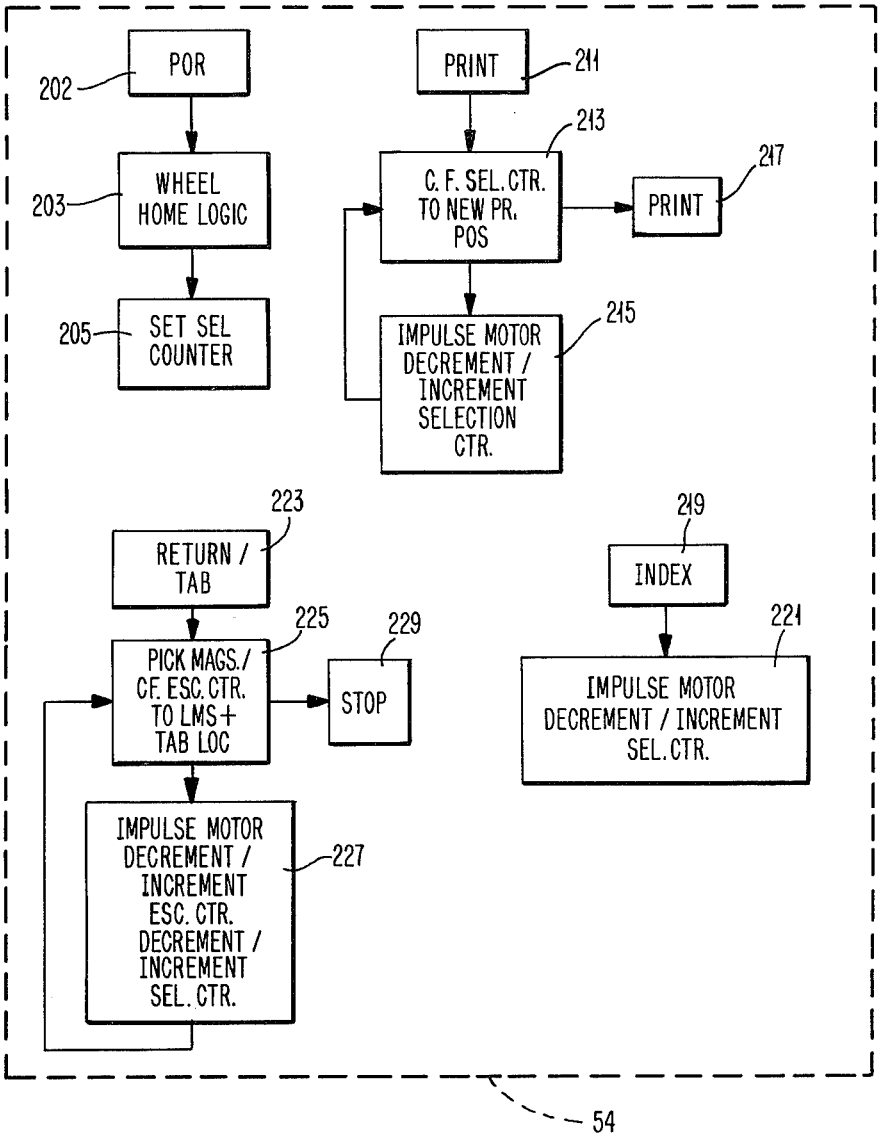
FIG. 9 is a block diagram of the logic system of the typewriter/printer.

Referring now to FIG. 9 of the drawing, a block diagram of the logic system 54 of FIG. 1 is depicted. When the machine is first turned on, the power on reset logic 202 generates a signal to the wheel home logic 203 causing the print wheel 31 of FIG. 1 to be rotated to its home position as noted by block 205, causing the selection counter to be reset to its initial value corresponding to the home position. The print wheel 31 may be homed in a manner similar to that described in U.S. Pat. No. 4,264,220 entitled "Printwheel Homing Apparatus" which issued Apr. 28, 1981 and is assigned to International Business Machines Corporation.

Thereafter, when a print operation is defined as noted by block 211, the value in the selection counter is compared with a value corresponding to the print position of the character to be printed as noted by block 213. If the comparison is not equal, the stepper motor 47 of FIG. 1 is incremented to effect rotation in either a clockwise or counterclockwise direction and the selection counter is incremented or decremented as noted by block 215. Once the new print position compares to the selection counter, a printing operation is effected as noted by block 217. During this operation, the print hammer unit 35 of FIG. 1 is caused to impact the selected daisy petal 43 of FIG. 1. Thereafter, the escapement magnet 37 is impulsed allowing the print carrier 29 to move to the next position to be printed.

Referring again to FIG. 9 of the drawing, when a line index operation is specified as represented by block 219, the stepper motor 47 of FIG. 1 is impulsed to effect rotation of the platen 23 in the proper direction and the selection counter is incremented or decremented depending on the direction of rotation as indicated by block 221.

When a print carrier 29 return operation is specified as depicted in block 223, the magnets 37 and 73 of FIG. 1 are picked, the contents of an escapement counter are compared to the setting of the left margin stop or tab stop as depicted by block 225 and, if they are not equal, the stepper motor 47 of FIG. 1 is impulsed, the escapement counter is incremented or decremented, and the selection counter is incremented or decremented as depicted in block 227. This operation continues until the escapement counter compares equal to the left margin stop or tab stop at which time the operation is stopped as denoted by block 229. At this time, the magnets 37 and 73 of FIG. 1 are dropped releasing the print carrier 29 of FIG. 1 from the belt 49 of FIG. 1 and allowing the pawl 39 to seat in the rack 41.

While the typewriter/printer 11 has been described utilizing a daisy wheel 31 typefont, the invention is equally applicable to other styles of typefonts or print elements such as the "ball" typefont utilized in the IBM "Selectric" typewriter. Further, while the ribbon plate 153 is depicted as mounted to and forming a part of the print carrier 29, the typewriter/printer 11 would work equally as well with a frame 15 mounted ribbon system. Additionally, while the sub-carrier 61 pulley arrangement described with respect to the preferred embodiments results in sub-carrier 61 fractional motion equal to one-half of that of the print carrier 29, it is recognized by those skilled in the art that other pulley arrangements could be utilized resulting in different fractional motion of the sub-carrier 61.

While the invention has been particularly shown and described with reference to the preferred embodiments thereof, it will be understood by those skilled in the art that the foregoing and other changes in form and detail may be made therein without departing from the spirit and scope of the invention.

What is claimed is:

1. An impact printer comprising:

a frame;

a platen mounted on the frame for supporting an image receiving document;

a print carrier for moving a distance in a print direction relative to the platen from print position to print position on the document;

a sub-carrier drivingly connected to the print carrier for moving a fractional part of said distance as said print carrier is moved;

escapement means for moving said print carrier and said sub-carrier;

a movable print element mounted on said print carrier and having plural character representations thereon for impacting the document at a print position with a selected character representation;

character selection means for moving said print element to select said selected character representation for impact including:

a motor means mounted on said frame;

and a belt means drivingly connected to said motor means and said print element for effecting motion of said print element upon corresponding motor means motion, said belt means engaging said sub-carrier so that movement of said print carrier and said sub-carrier in response to said escapement means effects no character selection movement of said belt means and said print element.

2. The impact printer of claim 1 further comprising:

selectively actuable clamp means mounted on said print carrier for fixedly engaging said belt means; and logic means for actuating said clamp means and said motor means to move said belt means whereby said print carrier and said sub-carrier are moved according to the rotation of said motor means.

3. The impact printer of claim 2 wherein said logic means keeps track of the position of said print element during movement of said print carrier and said sub-carrier upon rotation of said motor means.

4. The impact printer of claim 1 wherein said escapement means includes:

biasing means for urging said print carrier in the print direction; and escapement increment means for controlling the amount of movement effected by said biasing means of said print carrier in said print direction.

5. The impact printer of claim 1 or claim 4 further including adjustable biasing means for biasing said print carrier and said subcarrier away from one another in the direction of motion of said print carrier.

6. The impact printer of claim 4 wherein said biasing means provides a uniform biasing force on said print carrier regardless of its escapement position along the print line.

7. The impact printer of claim 4 wherein said impact printer further includes:

selectively actuable clamp means mounted on said print carrier for fixedly engaging said belt means; and logic means for actuating said clamp means and said motor means to move said belt means whereby said print carrier and said sub-carrier are moved in a direction opposite said print direction and wherein said biasing means includes a windable spring motor being wound upon actuation of said clamp means and said motor means and being unwound during motion of said print carrier in said print direction.

8. The impact printer of claims 4, 6 or 7 wherein said escapement increment means includes a toothed member, the pitch of the teeth of the toothed member controlling the amount of movement of said print carrier.

9. The impact printer of claim 5 wherein the adjusted biasing force provided by said adjustable biasing means is constant regardless of the relative and actual positions of said print carrier and said sub-carrier.

10. The impact printer of claim 1 wherein said belt means is a continuous drive belt extending from said motor means around a first pulley located on said sub-carrier, thence about a pulley located on said print carrier thence about a second pulley located on said sub-carrier and thence to said motor means, rotating motion of said pulley located on said print carrier effecting motion of said print element.

11. The impact printer of claim 10 wherein said motor means is a stepper motor.

12. The impact printer of claims 1, 2 or 3 further including line indexing means selectively connected to said motor means for effecting line indexing upon operation of said motor means upon selective connection thereto.

13. The impact printer of claim 1 wherein said escapement means includes a bi-directional stepper motor connected to said print carrier and said sub-carrier for moving said print carrier by a given distance in either a first or a second direction and for moving said sub-carrier in the same direction by a fractional amount of said distance.

14. The impact printer of claim 13 wherein said fractional distance is one-half said given distance and wherein said belt means being a continuous drive belt extending from said motor means around a first pulley located on said sub-carrier, thence about a pulley located on said print carrier thence about a second pulley located on said sub-carrier and thence to said motor means, rotating motion of said pulley located on said print carrier effecting motion of said print element.

15. The impact printer of claim 1 wherein said escapement means includes a second motor means drivingly connected to said print carrier and said sub-carrier for controlling the amount and direction of movement of said print carrier and said sub-carrier.

16. An impact printer including:

a frame;

a character selection drive motor mounted on said frame;

a print carrier mounted for movement relative to the frame along a print line;

character print element means containing plural print characters movable to select one of said print characters for printing and mounted on said print carrier;

a sub-carrier mounted for movement relative to said frame in a direction parallel to the movement of said print carrier;

continuous belt means connecting said drive motor to said sub-carrier and to said print element means, rotation of said drive motor effecting corresponding print character selection movement; and escapement means connected to said sub-carrier for incrementally moving said sub-carrier, movement of said sub-carrier moving said print carrier through said belt means without effecting print character selection movement.

17. The impact printer of claim 16 further including adjustable biasing means for biasing said print carrier and said sub-carrier away from one another in the direction of motion of said print carrier.

18. The impact printer of claim 17 wherein said biasing means provides a uniform biasing force on said print carrier regardless of its escapement position along the print line.

19. The impact printer of claim 17 wherein the adjusted biasing force provided by said adjustable biasing means is constant regardless of the relative and actual positions of said print carrier and said sub-carrier.

20. The impact printer of claim 16 wherein said belt means is a continuous drive belt extending from said motor around a first pulley located on said sub-carrier, thence about a pulley located on said print carrier thence about a second pulley located on said sub-carrier and thence to said motor, rotating motion of said pulley located on said print carrier effecting print character selection movement of said print element means.

21. A character selection and escapement system for an impact printer having a print line advancement system including:

a frame;

a movable platen mounted on the frame for supporting an image receiving document, movement of the platen advancing the document to receive successive lines of printing thereon;

a print carrier for moving a distance in a print direction relative to the platen from print position to print position on the document on a line of printing;

a movable print element mounted on said print carrier having plural character representations thereon for impacting the document at a print position with a selected character representation;

a motor means directly coupled to said movable print element for moving said print element to select said selected character representation;

a sub-carrier drivingly connected to the print carrier for moving a fractional part of said distance as said print carrier is moved;

escapement means for moving said print carrier and said sub-carrier;

line advance means selectively coupled to said motor means for effecting movement of said platen upon selection of said line advance means and upon rotation of said motor means; and means connecting one of said print element or said line advance means to said motor means including a belt means drivingly connected to said motor means and to said one of said print element or said line advance means for effecting motion of said one of said print element or said line advance means upon corresponding motor means motion, said belt means engaging said sub-carrier so that movement of said print carrier and said sub-carrier in response to said escapement means effects no movement of said one of said print element or said line advance means.

22. The character selection and escapement system of claim 21 wherein said motor means is mounted on said print carrier and wherein said belt means is connected to said line advance means.

23. The character selection and escapement system of claim 21 wherein said motor means is mounted on said frame and wherein said belt means is connected to said print element.

24. The character selection and escapement system of claim 22 or 23 further including adjustable biasing means for biasing said print carrier and said sub-carrier away from one another in the direction of motion of said print carrier.

25. The character selection and escapement system of claim 24 wherein the adjusted biasing force provided by said adjustable biasing means is constant regardless of the relative and actual positions of said print carrier and said sub-carrier.

26. The character selection and escapement system of claim 23 wherein said belt means is a continuous drive belt extending from said motor means around a first pulley located on said sub-carrier, thence about a pulley located on said print carrier thence about a second pulley located on said sub-carrier and thence to said motor means, rotating motion of said pulley located on said print carrier effecting motion of said print element.

27. A character selection and escapement system for a serial impact printer including:

a frame;

a platen mounted on the frame for supporting an image receiving document;

a print carrier for moving a distance in a print direction relative to the platen from print position to print position on the document;

a rotatable print element mounted on said print carrier, having plural character representations thereon for impacting the document at a print position with a desired character representation, said print element having a shaft journaled for rotation on said print carrier;

a motor means for rotating said print element to select said desired character representation characterized by:

a sub-carrier drivingly connected to the print carrier for moving a fractional part of said distance as said print carrier moves;

escapement means for moving said print carrier and said sub-carrier in the print direction;

an endless belt wrapped around a first pulley secured to said shaft and around a second pulley whose axis of rotation is fixed in translation with respect to said frame, the endless belt engaging the sub-carrier so that translational movements of the print carrier and the sub-carrier in response to said escapement means effect no rotation of said first and second pulleys whereby the rotational position of the print element is not affected during escapement of said print carrier; and said motor means being drivingly connected to one of said first pulley or said second pulley for effecting rotation of said endless belt and said print element.

* * * * *